US006620504B2

(12) United States Patent
Mizumura et al.

(10) Patent No.: US 6,620,504 B2
(45) Date of Patent: Sep. 16, 2003

(54) THICK AND THIN POLYESTER MULTIFILAMENT YARN

(75) Inventors: Tomoo Mizumura, Matsuyama (JP); Nobuyoshi Miyasaka, Ibaraki (JP)

(73) Assignee: Teijin Limited, Osaka (JP)

( * ) Notice: Subject to any disclaimer, the term of this patent is extended or adjusted under 35 U.S.C. 154(b) by 0 days.

(21) Appl. No.: 10/129,545

(22) PCT Filed: Sep. 12, 2001

(86) PCT No.: PCT/JP01/07921

§ 371 (c)(1),
(2), (4) Date: May 8, 2002

(87) PCT Pub. No.: WO02/22931

PCT Pub. Date: Mar. 21, 2002

(65) Prior Publication Data

US 2003/0066281 A1 Apr. 10, 2003

(30) Foreign Application Priority Data

Sep. 13, 2000 (JP) ..... 2000-277855

(51) Int. Cl.[7] ..... D01F 6/00; D01F 6/62

(52) U.S. Cl. ..... 428/357; 428/364; 428/395

(58) Field of Search ..... 428/357, 364, 428/375, 370, 395; 264/172.17

(56) References Cited

FOREIGN PATENT DOCUMENTS

| | | | |
|---|---|---|---|
| JP | 0 187 362 | A2 | 7/1986 |
| JP | 62-85021 | A | 4/1987 |
| JP | 62-85022 | A | 4/1987 |
| JP | 62-85073 | A | 4/1987 |
| JP | 6-81239 | A | 3/1994 |
| JP | 2002161434 | * | 6/2002 |

* cited by examiner

*Primary Examiner*—Newton O Edwards
(74) *Attorney, Agent, or Firm*—Sughrue Mion, PLLC

(57) ABSTRACT

A thick and thin polyester multifilament yarn having an excellent natural fiber yarn-like hand, a dry touch and spun yarn-like appearance includes a plurality of individual thick and thin polyester multifilaments varying in thickness along the longitudinal direction thereof and exhibits a spectrum having a first peak (Pmax1) of a coefficient of variation in yarn thickness of 4 to 10 cm, a second peak (Pmax2) of the yarn thickness variation coefficient of 50 to 150 cm and a ratio (Pmax1/Pmax2) of 1.5 to 4.0, measured by the normal mode test method using the Uster evenness tester.

7 Claims, 1 Drawing Sheet

THICK AND THIN POLYESTER MULTIFILAMENT YARN

TECHNICAL FIELD

The present invention relates to a thick and thin polyester multifilament yarn. More particularly, the present invention relates to a thick and thin polyester multifilament yarn having a natural fiber-like or filament yarn-like hand, a dry touch and a spun yarn-like appearance.

BACKGROUND ART

It is well known that when an undrawn polyester multifilament yarn is incompletely drawn, a thick and thin polyester multifilament yarn is obtained. In this thick and thin multifilament yarn, with an increase in the unevenness in the thickness of the yarn, naturally, the special hand of the yarn is enhanced. If the unevenness in the thickness of the yarn is too high, a problem, that the resultant yarn is disadvantageous in that the natural multifilament yarn-like hand of the yarn is deteriorated and the easy handing and mechanical properties of the yarn are degraded due to the presence of the undrawn portion having a low degree of orientation in the filaments, occurs.

To solve the above-mentioned problem, Japanese Examined Patent Publication No. 3-77304 discloses a thick and thin filament yarn in which the thick portions of the individual filaments are specifically dispersed and in which a thickness value, at a yarn thickness variation period of 50 cm, in a spectrogram obtained by the normal mode test using the Uster unevenness tester, is ½ or less of the maximum value of the yarn thickness. It is true that the thick and thin filament yarn of the Japanese publication exhibits enhanced mechanical property and handling property. However, the hand of the thick and thin filament yarn may be unsatisfactory for a certain use, and thus further improvement of the yarn, in the natural fiber or filament yarn-like hand, the dry touch and the spun yarn-like appearance, is strongly desired.

SUMMARY OF THE INVENTION

The present invention was made on the basis of the above-mentioned background art.

An object of the present invention is to provide a new thick and thin polyester multifilament yarn having an excellent natural fiber or filament yarn-like hand, a good dry touch and a spun yarn-like appearance.

The above-mentioned object can be attained by the thick and thin polyester multifilament yarn of the present invention which comprises a plurality of thick and thin polyester individual filaments, the thickness of which periodically varies along the longitudinal direction thereof, wherein when the thick and thin multifilament yarn is subjected to a yarn thickness variation measurement by the normal mode test method using the Uster evenness tester, the resultant spectrogram of the thick and thin multifilament yarn exhibits a first peak ($P_{max1}$) of the coefficient of variation in yarn thickness at a thickness variation period of 4 to 10 cm and a second peak ($P_{max2}$) of the coefficient of variation of the yarn thickness at a thickness variation period of 50 to 150 cm, and the ratio ($P_{max1}/P_{max2}$) of the first peak coefficient of variation in the yarn thickness ($P_{max1}$) to the second peak coefficient of variation in the yarn thickness ($P_{max2}$) in the range of from 1.5 to 4.0.

The thick and thin polyester multifilament yarn of the present invention preferably exhibits, in the spectrogram of the thick and thin multifilament yarn, a ratio ($P_{max1}/P_{20}$) of the first peak coefficient of variation in the yarn thickness ($P_{max1}$) to a coefficient of variation in the yarn thickness at a thickness variation period of 20 cm ($P_{20}$) in the range of 1.5 to 4.0.

In the thick and thin polyester multifilament yarn of the present invention, preferably, the individual thick and thin multifilaments have thick portions having a length in the range of 1 to 15 mm, and the thick and thin multifilament yarn has a U %, which is a mean yarn thickness unevenness represented by a ratio in % of the mean deviation to the mean value of the yarn thickness, of 3.5% or more, as determined by the normal mode test method using the Uster evenness tester at a yarn speed of 400 m/min at a twist number of 5500 turns/min for one minute.

The thick and thin polyester multifilament yarn of the present invention, preferably, has a shrinkage in boiling water of 10% or less.

In the thick and thin polyester multifilament yarn of the present invention, preferably, the individual thick and thin multifilaments each have a triangular cross-sectional profile.

In the thick and thin polyester multifilament yarn of the present invention, the individual thick and thin multifilaments preferably contain a fine pore-forming agent mixed into a matrix consisting of a polyester resin.

In the thick and thin polyester multifilament yarn of the present invention, the fine pore-forming agent preferably comprises a metal salt compound represented by the general formula (I):

(I)

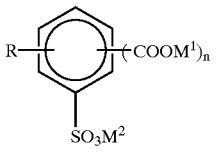

in which formula (I), $M^1$ and $M^2$, respectively and independently from each other, represent a metal atom, R represents a hydrogen atom or an ester structure-forming functional group and n represents an integer of 1 or 2.

BEST MODE OF CARRYING OUT THE INVENTION

Figure 1:
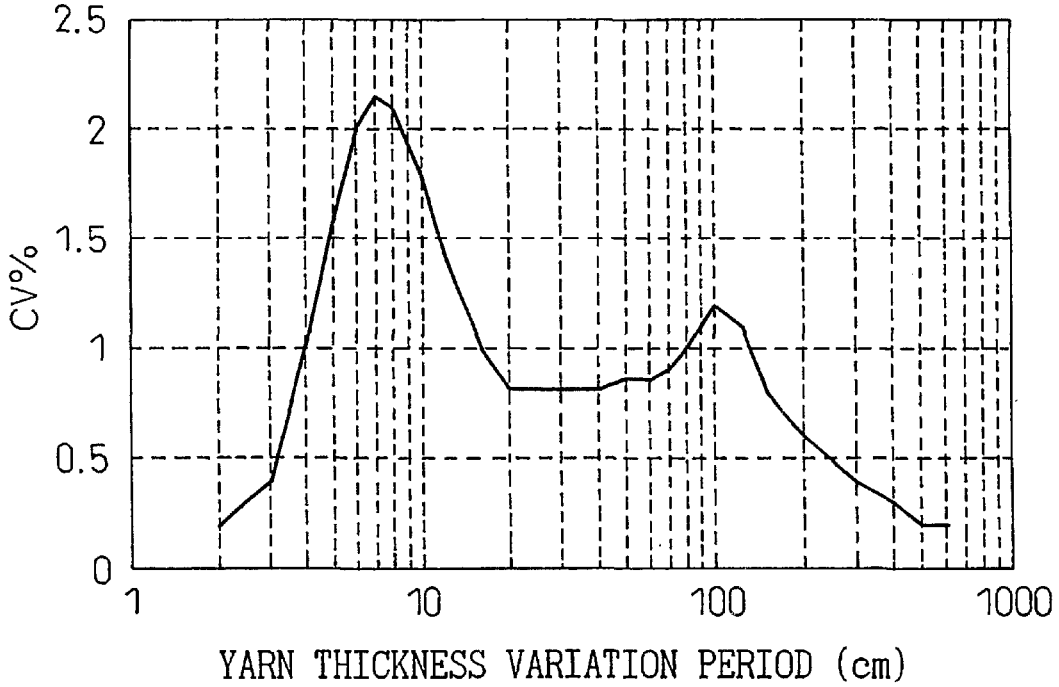
FIG. 1 is a spectrogram of an embodiment of the thick and thin polyester multifilament yarn of the present invention, obtained by the normal mode test using the Uster unevenness tester, showing a relationship between the yarn thickness variation period and the coefficient of variation in yarn thickness of the yarn.

The thick and thin polyester multifilament yarn of the present invention will be explained in detail below.

The polyester usable for the present invention is principally selected from polyethylene terephthalates having repeating units consisting of ethylene terephthalate groups, and optionally from polyethylene terephthalate-copolymerized polyesters in which at least one additional component, usually in a small amount of 15 molar % or less, preferably 10 molar % or less, still preferably 5 molar % or less, based on the molar amount of all the recurring units is copolymerized.

The polyester resin usable for the present invention may contain an additive, for example, a delusterant. Particularly, the polyester resin preferably contains a fine pore-forming agent for forming fine pores or grooves on the surfaces of, or inside, the filaments when the filaments are subjected to a weight-reduction treatment with an alkali, because the water-absorbing property, the natural fiber or filament yarn-like hand, a brightness and a dry touch of the resultant filament yarn can be improved in response to the form, size and distribution of the pores or grooves.

For example, when the polyester resin contains, as a fine pore-forming agent, a sulfonate metal salt represented by the following general formula (I), (I)

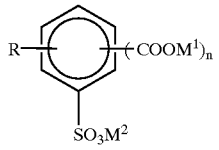

in which formula (I), M and $M^1$, respectively and independently from each other, represent a metal atom, preferably a member selected from alkali metal, alkaline earth metal, manganese, cobalt and zinc atoms, R represents a hydrogen atom or a ester-formable functional group, and an represents an integer of 1 or 2, the resultant polyester multifilament yarn exhibits an improved dry touch and cotton fiber yarn-like properties.

The above-mentioned sulfonate metal salt is preferably selected from those disclosed in Japanese Examined Patent Publication No. 61-31231. Particularly, 3-sodium 3-carboxybenzenesulfonate-5-sodium carboxylate, and 3-sodium hydroxyethoxycarbonylbenzenesulfonate-5-½ magnesium carboxylate are usable.

The addition of the above-mentioned sulfonate metal salt to the polyester resin can be carried out at any stage before melt-spinning step of the polyester resin. For example, the sulfonate metal salt is mixed into the materials for the synthesis of the polyester or added during the synthesis procedure of the polyester.

The amount of the sulfonate metal salt to be added to the polyester is preferably 0.5 to 2.5% by weight, more preferably 0.6 to 1.2% by weight, based on the weight of the polyester. If the content of the sulfonate metal salt is too low, the resultant polyester filaments may exhibit an unsatisfactory cotton fiber-like hand, and if it is too high, the melt spinning procedure of the resultant polyester resin composition may be troublsome.

In the present invention, the spectrogram is a graph showing a relationship between the yarn thickness variation period (cm) and the coefficient of variation of the yarn thickness (CV %) of the thick and thin polyester multifilament yarn and prepared by the normal mode test method using the Uster evenness tester spectrograph (made by zellweger Uster Co., Switzerland) at a yarn speed of 400 m/min. The Uster spectrograph enables details of unevenness of the yarn to be quickly measured and analized, and is particularly useful for determining the period of the yarn thickness variation.

The theory and practice of the yarn thickness evenness measurement by the Uster evenness tester spectrograph are described in detail in ⌈Theory and Practice of Unevenness⌋, the Textile Machinery Society of Japan, pages 255 to 372.

Figure 2:
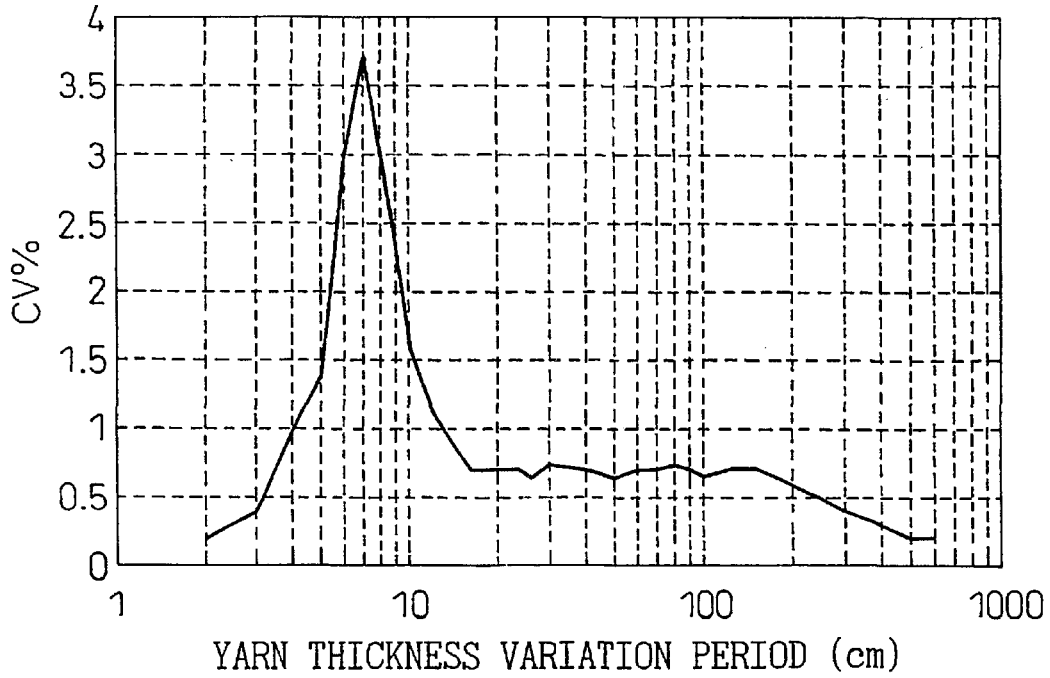
Fig.2 (PRIOR ART)
FIG. 2 is a spectrogram of an embodiment of conventional thick and thin polyester multifilament yarn obtained by the same test as mentioned above.

Spectrograms of examples of the thick and thin polyester multifilament yarns of the present invention and the conventional thick and thin polyester multifilament yarns are shown in FIGS. 1 and 2, respectively and will be explained in detail below. FIG. 1 is a spectrogram of the thick and thin polyester multifilament yarn prepared in Example 1 which will be described hereinafter, and FIG. 2 is a spectrogram of a conventional thick and thin polyester multifilament yarn. In a comparison of FIG. 1 with FIG. 2, a characteristic difference therebetween resides in the number of peaks in the yarn thickness variation coefficient (CV %) appearing in the spectrograms. Namely, in the thick and thin polyester multifilament yarn of the present invention, two peaks in CV % appear in the range of 50 to 150 cm of the long yarn thickness variation period and in the range of 4 to 10 cm of the short yarn thickness variation period, and thus the thickness of the yarn is widely dispersed. Compared with this, in FIG. 2, only one peak appears in the short yarn thickness variation period of 4 to 10 cm and no peak appeared in the long yarn thickness variation period. Therefore, the thick and thin polyester multifilament yarn exhibits a more natural spun yarn-like appearance than that of the conventional yarn.

When the thick and thin polyester multifilament yarn of the present invention is subjected to a normal mode test for evenness in the thickness thereof using the Uster unevenness tester, two peaks in CV (%) of the yarn appear in the resultant spectrogram of the yarn. A first peak ($P_{max\text{-}1}$) appears in the ranges of the yarn thickness variation period of from 4 to 10 cm, preferably 5 to 8 cm and a second peak ($P_{max\text{-}2}$) appears in the ranges of the yarn thickness variation period of from 50 to 150 cm, preferably 80 to 120 cm. Also, the ratio $(P_{max\text{-}1})/(P_{max\text{-}2})$ of the first peak value ($P_{max\text{-}1}$) in CV % to the second peak value ($P_{max\text{-}2}$) in CV % must be in the range of 1.0 to 4.0, preferably 1.5 to 2.0. If the spectrogram shows only one peak in CV %., or at least one of the peaks appears outside of the above-mentioned specific ranges of the yarn thickness variation period or the peak value ratio $(P_{max\text{-}1})/(P_{max\text{-}2})$ falls outside of the above-mentioned specific range, the resultant thick and thin polyester multifilament yarn exhibits a reduced random variance in distribution of the thick portions thereof and thus the natural fiber or filament yarn-like hand of the resultant yarn is degraded or the dry touch and/or the spun yarn-like appearance of the yarn is deteriorated to an extent such that the purpose of the present invention is not completely attained.

In the spectrogram of the thick and thin polyester multifilament yarn of the present invention, when the CV % value ratio $(P_{max\text{-}1})/(P_{20})$ of the first peak CV % value ($P_{max\text{-}1}$), as defined above, to a CV % value ($P_{20}$) appearing at a yarn thickness variation period of 20 cm is in the range of 1.5 to 4.0, preferably 2.0 to 3.0, the resultant yarn advantageously exhibits improved natural fiber or filament yarn-like hand, a dry touch and a spun yarn-like appearance.

In the thick and thin polyester multifilament yarn of the present invention, preferably, the thick portions of the individual filaments have an length of 1 to 15 mm, more preferably 3 to 10 mm. If the thick portion length is too long, the resultant yarn may exhibit a degraded natural fiber or filament yarn-like hand, and if the thick portion length is too short, the specific properties of the thick and thin yarn may not be satisfactorily exhibited. Further, the thick and thin polyester multi-filament yarn of the present invention preferably has an Uster normal U % of 3.5% or more, more preferably in the range of 4.5 to 8.0%.

The Uster normal mode U % is a mean yarn thickness unevenness represented by a ratio in % of the mean deviation to the mean value of the yarn thickness determined by the normal mode test method using the Uster evenness tester at a yarn speed of 400 m/min. at a twist number of 5500 turns/min. for one minute.

The U % value in the above-mentioned range enables both the rough touch and the natural fiber or filament fabric-like hand of the resultant thick and thin polyester multifilament yarn fabric to be realized.

There is no limitation to the mean thickness of the individual thick and thin filaments and the average total thickness of the yarn. Usually, the mean thickness of the individual thick and thin filaments is preferably 1.5 to 5.0 dtex and the mean total thickness of the yarn is preferably 40 to 170 dtex.

Also, there is no limitation to the cross-sectional profile and dimensions of the thick and thin individual filaments. A circular cross-sectional profile of the individual filaments may enable the resultant multifilament yarn to exhibit the natural fiber spun yarn-like appearance. The thick and thin multifilaments having a triangular cross-sectional profile enable the resultant yarn to exhibit an enhanced dry touch and a spun yarn-like appearance.

The above-mentioned thick and thin polyester multifilament yarn of the present invention can be produced by, for example, the following method.

An above-mentioned polyester is melted at a temperature of 280 to 300° C., the polyester melt is extruded through a spinneret and solidified by cooling; the resultant undrawn filaments were oiled with an oiling agent, and then interlaced in an interlacing apparatus provided with three or more air-ejection openings through which air blasts were ejected under a pressure of 0.1 to 0.3 MPa toward the oiled undrawn filaments; the resultant interlaced undrawn filament yarn was semi-drawn between a preheating roller having a periphery temperature equal to or lower than the glass transition temperature of the polyester and a drawing roller at a feeding speed on the preheating roller of 1500 to 2500 m/min at a draw ratio of 1.1 to 1.5; and the semi-drawn filament yarn was wound around a winder bobbin. Then, the wound semi-drawn filament yarn was unwound and introduced at a feeding speed of 600 to 1400 m/min into a drawing apparatus in which the fed semi-drawn filament yarn is heated to a temperature of 80 to 110° C. on a periphery of a preheating roller and then to a temperature of 170 to 220° C. in a non-contact type heater, and then drawn at a draw ratio of 1.1 to 2.0 to provide a thick and thin polyester multifilament yarn. Optionally, the multifilament yarn was further preheated to a temperature of 150 to 190° C. by a contact type or non-contact type heater and heat-set at a draw ratio of 0.8 to 1.1.

In the process for producing the thick and thin polyester multifilament yarn of the present invention, the first peak ($P_{max1}$), the second peak ($P_{max2}$) and the ($P_{max1}$)/($P_{max2}$) ratio can be adjusted by changing the conditions of the above-mentioned steps, for example, the cross-sectional profile of the undrawn filaments in the melt-extruding step, the pressure of the air blasts applied to the undrawn filaments in the interlacing step, the draw ratio for the undrawn filaments in the semi-drawing step, the tension distribution on the semi-drawn filaments on the pre-heating roller in the heat-setting step and the draw ratio on the semi-drawn filaments in the heat-setting step.

To produce a fabric from the above-mentioned thick and thin polyester multifilament yarn of the present invention, the yarn is optionally twisted at a desired twist number, and is woven or knitted into a desired fabric structure. The fabric is optionally subjected to a weight reduction treatment with an aqueous alkali solution. The weight reduction treatment contributes to enhancing the spun yarn fabric appearance, the natural fiber or filament fabric-like appearance and the dry touch of the fabric to an extent that the conventional polyester multifilament yarn fabric could not attain.

Since the present invention is intended to provide a thick and thin polyester multifilament yarn fabric having an enhanced spun yarn fabric-like appearance, a natural fiber or filament yarn fabric-like hand and a dry touch, the fabric preferably has a simple weave or knitting structure selected from, for example, plain weave structures, modified plain weave structures, simple twill weave structures, modified simple twill weave structures, and satin weave structures, but complicated weave and knitting structures are not preferred for the fabric formed from the yarn of the present invention. The fabric is not limited to a fabric consisting of the thick and thin polyester multifilament yarn of the present invention in a content of 100%. However, the content of the yarn of the present invention in the fabric is preferably as high as possible, to enhance the spun yarn-like appearance, the natural fiber or filament yarn fabric-like hand and the dry touch.

In another embodiment of the present invention, the thick and thin polyester multifilament yarn is a composite yarn comprising (A) a plurality of individual thick and thin polyester multifilaments having an ultimate elongation (ELA) of 80% or more, an elastic recovery of 50% or less from 10% strain (elongation), a modulus of rigidity in stretch (EMA) of 5.89 GPa or less, a crystallinity (XpA) of 25% or more, a shrinkage in boiling water (BWSA) of 3% or less, and a thermal stress (TSA) at 160° C. of 0.44 mN/dtex and (B) a plurality of individual drawn polyester filaments having an ultimate elongation (ELB) of 40% or less, a modulus of rigidity in stretch (EMB) of 7.85 GPa or more, a shrinkage in boiling water (BWSB) of 5% or more and a thermal stress (TSB) at 160° C. of 0.88 mN/dtex or more, the filaments (A) and the filaments (B) being intermingled with each other.

The intermingling of the filaments (A) with the filament (B) is preferably effected by applying air blasts, jetted from an air jet fiber-intermingling apparatus, toward the filaments (A) and (B) parallel with each other at room temperature.

Preferably, the thick and thin polyester filaments (A) have a triangular cross-sectional profile.

Also, the thick and thin polyester filaments (A) contain the above-mentioned fine pore-forming agent.

In still another embodiment of the present invention, the thick and thin polyester multifilament yarn is a composite yarn produced by paralleling two or more types of undrawn polyester multifilament yarns different in natural draw ratio from each other; and drawing the parallel multifilament yarns at a draw ratio lower than the highest value and higher than the lowest value of the natural draw ratios of the parallel undrawn multifilament yarns.

In this embodiment, after the undrawn multifilament yarns are paralleled each other, the resultant undrawn yarn is subjected to a filament-intermingling procedure with air blasts jetted from an air-jet fiber-intermingling apparatus toward the undrawn yarn at room temperature, and then filament-intermingled yarn is drawn.

The undrawn polyester multifilament yarn having the highest natural draw ratio preferably contains the above-mentioned fine pore-forming agent.

The lowest value of the natural draw ratios of the undrawn multifilament yarns to be paralleled each other is preferably in the range of from 1.1 to 1.7, more preferably 1.3 to 1.5. The highest value of the natural draw ratios of the undrawn yarns is preferably 0.5 above, more preferably 0.7 above, the lowest value of the natural draw ratios of the undrawn yarns, and is within the range of from 2.0 to 6.0.

In this embodiment, the intermingling ratio of the undrawn filaments, different in the natural draw ratio from each other, to each other, may be established in response to the desired properties and the use of the resultant yarn. Preferably, the contents of the undrawn filaments having a lowest natural draw ratio and the undrawn filament having a highest natural draw ratio are 20% by weight or more, respectively. Particularly, the content of the undrawn filaments having the higher natural draw ratio is preferably higher than that of the lower natural draw ratio. Preferably, the ratio in content in weight of the undrawn filaments having the lowest natural draw ratio to the undrawn filaments having the highest natural draw ratio is in the range of 30/70 to 45/55. Also, in this embodiment, the composite yarn may further comprise polyester multifilaments having a high shrinkage, for example, of 15% or more in boiling water, in a content of 45% by weight or less.

Further, in this embodiment, the composite yarn may further comprise polyester multifilaments having a latent crimping property and being capable of crimping, when heated at a high temperature, for example, 150° C. or more, in a content of 45% by weight or less.

The high shrinkage and/or polyester filaments mixed into the composite yarn enable the bulkiness of the resultant composite yarn to be enhanced.

EXAMPLES

The present invention will be further illustrated by the following examples which are merely representative and are not intended to restrict the scope of the present invention in any way.

Example 1

A glass flask equipped with a refining distillation column is charged with 197 parts by weight of dimethyl terephthalate, 124 parts by weight of ethylene glycol, 4 parts by weight of 3-carbomethoxy·sodium benzenesulfonate-5-sodium carboxylate (1.3 molar % based on the molar amount of the above-mentioned dimethyl terephthalate) and 0.118 part by weight of calcium acetate monohydrate; the charged reaction mixture was subjected to a transesterification reaction at a temperature of 240° C. for 2 hours; after the resultant methyl alcohol is distilled off in a stoichiometric amount, the remaining reaction product is placed in a polycondensation flask equipped with a refining distillation column and mixed with 0.112 part by weight of a stabilizer consisting of trimethyl phosphate and 0.079 part by weight of a polycondensation catalyst consisting of antimony oxide; the resultant reaction mixture was subjected to a polycondensation reaction at a temperature of 280° C. under the ambient atmospheric pressure of 20 minutes, then under a reduced pressure of 3999.6 Pa (30 mmHg) for 15 minutes, and further under a high vacuum for 80 minutes. The final inner pressure of the flask was 50.7 Pa (0.38 mmHg). The resultant modified polyester exhibited an intrinsic viscosity of 0.640, determined in orthochlorophenol at a temperature of 35° C., and a softening temperature of 258° C.

After the reaction was complete, the resultant modified polymer was pelletized, using a pelletizer.

The modified polymer pellets were dried at a temperature of 150 for 180 minutes, and then melt-extruded through a spinneret having 36 melt-spinning holes for undrawn filaments each having a triangular cross-sectional profile; the extruded filamentary polymer melt streams were solidified by cooling; the resultant undrawn filaments were oiled with an oiling agent, and then subjected to a interlacing procedure in which an interlacing apparatus equipped with three air-ejection nozzles was employed, and three air blasts were jetted through the air-ejection nozzles under a pressure of 0.15 MPa toward the undrawn filaments; the interlaced undrawn filaments were taken up at a speed of 2250 m/min, semi-drawn at a speed of 3030 m/min, at a draw ratio of 3030/2250=1.35, and the semi-drawn filaments were wound around a wider roll.

The semi-drawn filament was unwound and drawn at a preheating roller temperature of 87° C. and at a heat-setting heater (non-contact type) temperature of 200° C., at a draw ratio of 1.4 at a drawing speed of 800 m/min. The drawn filaments were heat-set by a heat-setting heater (contact type) at a temperature of 175° C. at a draw ratio of 0.98, and the heat set filaments were wound around a bobbin. The resultant thick and thin polyester multifilament yarn had a yarn count of 120 dtex/36 filaments. The individual filaments of the yarn had a triangular cross-sectional profile.

The thick and thin multifilament yarn was subjected to a spectrographic test using the Uster unevenness tester and the U % test and to a measurement of shrinkage in boiling water for 30 minutes.

The test-results and measurement results are shown in Table 1.

A plain weave fabric (Habutue) was produced from warp and weft yarns each consisting of the above-mentioned thick and thin polyester multifilament yarn. The plain weave fabric had a warp density of 86 yarns/25.4 mm and weft density of 78 yarns/25.4 mm. The polyester multifilament weave fabric was scoured, heat-set and subjected to a weight reduction treatment with an aqueous alkali solution in a weight reduction of 15%. Then, the fabric was subjected to an immersion dyeing procedure with a blue-coloring disperse dye. The dyed fabric was evaluated in dry touch, natural fiber or filament fabric hand and spun yarn fabric-like appearance.

The evaluation for each item was carried out by organoleptic examination of five skilled panelists, the evaluation results were classified into the following three classes.

| Class | Panelist's evaluation result |
|---|---|
| 3 | All panelists judged very good. |
| 2 | Three or more panelists judged good. |
| 1 | Three or more panelists judged bad. |

The evaluation results are shown in Table 1.

Example 2

A thick and thin polyester multifilament yarn was produced and tested in the same procedures as in Example 1 with the following exceptions.

In the interlacing step, the three air blasts were ejected under a pressure of 0.25 MPa toward the undrawn filaments.

The test results are shown in Table 1.

Example 3

A thick and thin polyester multifilament yarn was produced and tested in the same procedures as in Example 1 with the following exceptions.

In the melt-extruding procedure, the spinneret had 36 melt-spinning holes for undrawn filaments each having a circular cross-sectional profile.

The test results are shown in Table 1.

Comparative Example 1

A thick and thin polyester multifilament yarn was produced and tested in the same procedures as in Example 1 with the following exceptions.

In the preheating step, the semi-drawn filaments were fed to the preheating roller through a bending guide by which a variation in tension on the filaments was generated.

Comparative Example 2

A thick and thin polyester multifilament yarn was produced and tested with the same procedures as in Example 1 with the following exceptions.

In the heat-setting step, the draw ratio for the semi-drawn filaments was 1.05.

The test results are shown in Table 1.

Comparative Example 3

A thick and thin polyester multifilament yarn was produced and tested with the same procedures as in Example 1 with the following exceptions.

In the melt-extruding procedure, the melt-spinning holes each had a circular cross-sectional profile.

In the heat-setting procedure, the draw ratio for the semi-drawn filaments was 1.05.

The test results are shown in Table 1.

Comparative Example 4

A thick and thin polyester multifilament yarn was produced and tested with the same procedures as in Example 1 with the following exceptions.

In the interlacing step, the air blasts were applied under a pressure of 0.05 MPa toward the undrawn filaments.

Comparative Example 5

A thick and thin polyester multifilament yarn was produced and tested with the same procedures as in Example 1 with the following exceptions.

In the interlacing step, the air blasts were applied under pressure of 0.4 MPa toward the undrawn filaments.

The test results are shown in Table 1.

Comparative Example 6

A thick and thin polyester multifilament yarn was produced and tested in the same procedures as in Example 1 with the following exceptions.

In the heat-setting step, the draw ratio for the semi-drawn filaments was 2.1.

TABLE 1

| | | Item | | | | | | | | | | |
|---|---|---|---|---|---|---|---|---|---|---|---|---|
| | | Thick and thin polyester multifilament yarn | | | | | | | | Fabric properties | | |
| | | Period | | | | Thick portion | Shrinkage in boiling | | Cross- | | National | Spun yarn |
| Example No. | | $P_{max1}$ (cm) | $P_{max2}$ (cm) | $P_{max1}/P_{max2}$ | $P_{max1}/P_{20}$ | length (mm) | water (%) | (%) | sectional profile | Dry touch | fiber fabric-like hand | fabric-like appearance |
| Comparative | 1 | 7 | 100 | 1.1 | 1.2 | 0.5 | 8.0 | 2.0 | Triangle | 2 | 1 | 1 |
| Example | 2 | 20 | 160 | 1.6 | 2.0 | 15 to 25 | 8.0 | 9.0 | Triangle | 1 | 1 | 1 |
| | 3 | 20 | 160 | 1.6 | 2.0 | 15 to 25 | 8.0 | 9.0 | Circle | 1 | 1 | 1 |

TABLE 1-continued

| | | Item | | | | | | | | | | |
|---|---|---|---|---|---|---|---|---|---|---|---|---|
| | | Thick and thin polyester multifilament yarn | | | | | | | | Fabric properties | | |
| | | Period | | | | Thick portion | Shrinkage in boiling | | Cross- | | National | Spun yarn |
| Example No. | | $P_{max1}$ (cm) | $P_{max2}$ (cm) | $P_{max1}/P_{max2}$ | $P_{max1}/P_{20}$ | length (mm) | water (%) | (%) | sectional profile | Dry touch | fiber fabric-like hand | fabric-like appearance |
| Example | 1 | 7 | 100 | 1.6 | 2.0 | 3 to 12 | 5.5 | 5.5 | Triangle | 3 | 3 | 3 |
| | 2 | 7 | 100 | 2.0 | 3.5 | 3 to 12 | 5.5 | 5.5 | Triangle | 3 | 3 | 3 |
| | 3 | 7 | 100 | 1.6 | 2.0 | 3 to 12 | 5.5 | 5.5 | Circle | 2 | 3 | 2 |
| Comparative | 4 | 7 | 100 | 0.8 | 1.2 | 3 to 12 | 5.5 | 4.5 | Triangle | 2 | 1 | 1 |
| Example | 5 | 7 | 100 | 4.2 | 4.5 | 3 to 12 | 5.5 | 7.0 | Triangle | 3 | 1 | 1 |
| | 6 | 3 | 70 | 1.2 | 1.5 | 3 to 12 | 5.5 | 3.5 | Triangle | 1 | 1 | 1 |

INDUSTRIAL APPLICABILITY

The thick and thin polyester multifilament yarn of the present invention can be converted to a fabric having excellent natural fiber yarn-like hand, a dry touch and a spun yarn-like appearance which could not be exhibited by the conventional thick and thin polyester multifilament yarn fabrics.

Also, when the thick and thin filaments contain a fine pore-forming agent, the resultant thick and thin polyester multifilament yarn fabric can be dyed to a high color density, has a good perspiration absorbent property and a comfortable wearing property, and exhibits a cotton fabric-like hand and appearance.

Thus, the thick and thin polyester multifilament yarn of the present invention has high industrial applicability.

What is claimed is:

1. A thick and thin polyester multifilament yam comprising a plurality of thick and thin polyester individual filaments the thickness of which periodeally varies along the longitudinal direction thereof, wherein when the thick and thin multifilament yarn is subjected to a yam thickness variation measurement, in the normal mode test method using the Uster evenness tester, the resultant spectrogram of the thick and thin multifilament yam exhibits a first peak ($P_{max1}$) of the coefficient of variation in yam thickness at a thickness variation period of 4 to 10 cm and a second peak ($P_{max2}$) of the coefficient of variation in yam thickness at a thickness variation period of 50 to 150 cm, and the ratio ($P_{max1}/P_{max2}$) of the first peak coefficient of variation in the yam thickness ($P_{max1}$) to the second peak coefficient of variation in the yam thickness ($P_{max2}$) is in the range of from 1.0 to 4.0.

2. The thick and thin polyester multifilament yarn as claimed in claim 1 wherein, in the spectrogram of the thick and thin multifilament yarn, a ratio ($P_{max1}/P_{20}$) of the first peak coefficient of variation in the yarn thickness ($P_{max1}$) to a coefficient of variation in the yarn thickness, at a thickness variation period of 20 cm ($P_{20}$), is in the range of 1.5 to 4.0.

3. The thick and thin polyester multifilament yarn as claimed in claim 1, wherein the individual thick and thin multifilaments have thick portions having a length in the range of 1 to 15 mm, and the thick and thin multifilament yarn has a Uster normal mode U%, which is a mean yarn thickness unevenness represented by a ratio in % of the mean deviation to the mean value of the yarn thickness, of 3.5% or more, determined by the normal mode test method using the Uster evenness tester at a yarn speed of 400 m/min at a twist number of 5500 turns/min for one minute.

4. The thick and thin polyester multifilament yarn as claimed in claim 1, having a shrinkage in boiling water of 10% or less.

5. The thick and thin polyester multifilament yarn as claimed in claim 1, wherein the individual thick and thin multifilaments each have a triangular cross-sectional profile.

6. The thick and thin polyester multifilament yarn as claimed in claim 1, wherein the individual thick and thin multifilaments contain a fine pore-forming agent mixed into a matrix consisting of a polyester resin.

7. The thick and thin polyester multifilament yarn as claimed in claim 6, wherein the fine pore-forming agent comprises a metal salt compound represented by the general formula (I):

(I)

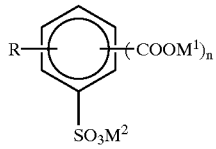

in which formula (I), $M^1$, and $M^2$, respectively and independently from each other, represent a metal atom, R represents a hydrogen atom or an ester structure-forming functional groups and n represents an integer of 1 or 2.

* * * * *

UNITED STATES PATENT AND TRADEMARK OFFICE

CERTIFICATE OF CORRECTION

PATENT NO. : 6,620,504 B2 
DATED : September 16, 2003
INVENTOR(S) : Tomoo Mizumura and Nobuyoshi Miyasaka It is certified that error appears in the above-identified patent and that said Letters Patent is hereby corrected as shown below:

Column 11,
Line 43, should read -- thin multifilament yarn is subjected to a yarn thickness --
Line 47, should read -- ($P_{max1}$) of the coefficient of variation in yarn thickness --
Line 49, should read -- ($P_{max2}$) of the coefficient of variation in yarn thickness --
Line 52, should read -- yarn thickness ($P_{max1}$) to the second peak coefficient of --
Line 53, should read -- variation in the yarn thickness ($P_{max2}$) is in the range of from --

Signed and Sealed this

Tenth Day of February, 2004

JON W. DUDAS
*Acting Director of the United States Patent and Trademark Office*